US007876574B2

(12) United States Patent
Takeichi et al.

(10) Patent No.: US 7,876,574 B2
(45) Date of Patent: Jan. 25, 2011

(54) ELECTRIC EQUIPMENT ASSEMBLY AND OUTDOOR UNIT OF AIR CONDITIONER PROVIDED WITH THE SAME

(75) Inventors: Hisashi Takeichi, Sakai (JP); Naohiro Kawasaki, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 463 days.

(21) Appl. No.: 12/091,006

(22) PCT Filed: Nov. 6, 2006

(86) PCT No.: PCT/JP2006/322072

§ 371 (c)(1),
(2), (4) Date: Apr. 21, 2008

(87) PCT Pub. No.: WO2007/052786

PCT Pub. Date: Oct. 5, 2007

(65) Prior Publication Data

US 2009/0122499 A1 May 14, 2009

(30) Foreign Application Priority Data

Nov. 7, 2005 (JP) ..... 2005-322252

(51) Int. Cl.
*H05K 7/14* (2006.01)
*H05K 7/18* (2006.01)

(52) U.S. Cl. ..... 361/796; 361/800

(58) Field of Classification Search ..... 361/54, 361/752, 730, 800, 790, 797, 810; 312/223.1, 312/223.2; 174/137 R, 151, 152 R, 139, 174/140, 140 R, 177, 179
See application file for complete search history.

(56) References Cited

U.S. PATENT DOCUMENTS

| | | | | |
|---|---|---|---|---|
| 4,109,482 | A * | 8/1978 | Pearson | 62/180 |
| 6,053,004 | A * | 4/2000 | Beppu et al. | 62/285 |
| 7,032,404 | B2 * | 4/2006 | Kim et al. | 62/262 |
| 7,305,844 | B2 * | 12/2007 | Cho et al. | 62/262 |
| 7,398,654 | B2 * | 7/2008 | Choi et al. | 62/285 |
| 2008/0074839 | A1 * | 3/2008 | Tamaki et al. | 361/687 |
| 2010/0025126 | A1 * | 2/2010 | Nakatsu et al. | 180/65.1 |

FOREIGN PATENT DOCUMENTS

| | | | |
|---|---|---|---|
| EP | 1 323 989 | A1 | 7/2003 |
| JP | 59-168684 | U | 11/1984 |
| JP | 09-236284 | A | 9/1997 |
| JP | 2002-106887 | A | 4/2002 |
| JP | 2003-65563 | A | 3/2003 |
| JP | 2003-294272 | A | 10/2003 |

* cited by examiner

*Primary Examiner*—Hung S Bui
(74) *Attorney, Agent, or Firm*—Global IP Counselors

(57) ABSTRACT

An electric equipment assembly is sized and configured to be disposed in a machine chamber of an outdoor unit. Reduction in size of the electric equipment assembly is achieved and simultaneously visibility and serviceability of a highly frequently accessed element are ensured, while employing a structure in which a control circuit board is covered by a protection cover. The electric equipment assembly includes a frame having a substrate attachment plate to which a control circuit board mounted with various electric components is attached and a substrate protection plate which covers the control circuit board. The outer surface of the substrate protection plate has a first auxiliary attachment portion formed thereon, to which a first auxiliary circuit board different from the control circuit board and mounted with a highly frequently accessed control element is attached.

12 Claims, 6 Drawing Sheets

ELECTRIC EQUIPMENT ASSEMBLY AND OUTDOOR UNIT OF AIR CONDITIONER PROVIDED WITH THE SAME

CROSS-REFERENCE TO RELATED APPLICATIONS

This U.S. National stage application claims priority under 35 U.S.C. §119(a) to Japanese Patent Application No. 2005-322252, filed in Japan on Nov. 7, 2005, the entire contents of which are hereby incorporated herein by reference.

TECHNICAL FIELD

The present invention relates to an electric equipment assembly and an air conditioner provided with the same. More specifically, in an outdoor unit of an air conditioner having a structure in which the inside of a casing having a generally rectangular parallelepiped box shape is divided into a fan chamber and a machine chamber by a partition plate extending vertically, the present invention relates to an electric equipment assembly disposed in the machine chamber, and to an outdoor unit of an air conditioner and an air conditioner provided with the same.

BACKGROUND ART

As a conventional outdoor unit of an air conditioner, there is known an outdoor unit having a structure in which the inside of a casing having a generally rectangular parallelepiped box shape is divided into a fan chamber and a machine chamber by a partition plate extending vertically. This fan chamber mainly includes an outdoor heat exchanger and an outdoor fan disposed therein. In addition, the machine chamber mainly includes a compressor, refrigerant circuit components comprising valves, refrigerant pipes, and the like, and an electric equipment assembly disposed therein. This type of electric equipment assembly includes a control circuit board on which operating control elements are mounted (see Japanese Patent Application Publication No. 09-236284).

SUMMARY OF THE INVENTION

With the above described electric equipment assembly, in some cases, a protection cover is provided to cover the control circuit board for protecting operators from electrical shock and high temperature. However, with such a structure, the following problems arise: reduction in size will be difficult to achieve; and visibility and serviceability of a highly frequently accessed control element (for example, a display element such as an LED and the like, and an operating element such as a switch, connector, and the like) will be reduced.

An object of the present invention is, in an electric equipment assembly disposed in a machine chamber of an outdoor unit having a structure in which the inside of a casing having a generally rectangular parallelepiped box shape is divided into a fan chamber and the machine chamber by a partition plate extending vertically, to simultaneously ensure visibility and serviceability of a highly frequently accessed control element and achieve reduction in size of the assembly while employing a structure in which a control circuit board is covered by a protection cover.

An electric equipment assembly according to a first aspect of the present invention is an electric equipment assembly disposed in a machine chamber of an outdoor unit of an air conditioner having a structure in which an inside of a casing having a generally rectangular parallelepiped box shape is divided into a fan chamber and the machine chamber by a partition plate extending vertically, the electric equipment assembly comprising a frame having a substrate attachment plate to which a control circuit board mounted with various electric components is attached and a substrate protection plate configured to cover the control circuit board. In addition, the outer surface of the substrate protection plate has a first auxiliary attachment portion formed thereon, to which a first auxiliary circuit board different from the control circuit board and mounted with a highly frequently accessed control element is attached.

With this electric equipment assembly, the outer surface of the substrate protection plate has the first auxiliary attachment portion formed thereon, to which the first auxiliary circuit board different from the control circuit board and mounted with the highly frequently accessed control element is attached. Accordingly, it is not necessary to mount the highly frequently accessed control element on the control circuit board, thus facilitating reduction in size of the electric equipment assembly and simultaneously providing access to the highly frequently accessed control element from the outer surface of the substrate protection plate. This structure enables simultaneously achieving reduction in size of the electric equipment assembly and ensuring visibility and serviceability of the highly frequently accessed control element.

An electric equipment assembly according to a second aspect of the present invention is the electric equipment assembly according to a first aspect of the present invention, wherein the outer surface of the substrate protection plate has a second auxiliary attachment portion formed thereon, to which a second auxiliary circuit board mounted with an additional-function control element necessary for adding an additional function is attached.

With this electric equipment assembly, it is possible to attach the second auxiliary circuit board mounted with the additional-function control element necessary for adding an additional function to the outer surface of the substrate protection plate, thus facilitating reduction in size of the electric equipment assembly and enabling to add an additional function at the same time.

An electric equipment assembly according to a third aspect of the present invention is the electric equipment assembly according to the first or the second aspect of the present invention, wherein, with the frame provided in the casing, the first auxiliary attachment portion is provided on the outer surface of the substrate protection plate, especially at a position closer to the front side of the casing.

With this electric equipment assembly, the highly frequently accessed control element is disposed at a position closer to the front side of the casing, thus further improving visibility and serviceability of the highly frequently accessed control element.

An electric equipment assembly according to a fourth aspect of the present invention is the electric equipment assembly according any of the first to the third aspects of the present invention, wherein, with the frame provided in the casing, the frame is provided such that the outer surface of the substrate protection plate is inclined to the front side of the casing.

With this electric equipment assembly, the frame is provided such that the outer surface of the substrate protection plate is inclined to the front side of the casing, thus further improving visibility and serviceability of the highly frequently accessed control element.

An outdoor unit of an air conditioner according to a fifth aspect of the present invention comprises a casing having a generally rectangular parallelepiped box shape, a partition plate extending vertically so as to divide the inside of the casing into a fan chamber and a machine chamber, and the electric equipment assembly according to any one of the first to the fourth aspects of the present invention, which is disposed in the machine chamber.

This outdoor unit of the air conditioner is provided with the electric equipment assembly according to any one of the first to the fourth aspects of the present invention, thus enabling simultaneously achieving reduction in size of the outdoor unit itself and ensuring visibility and serviceability of the highly frequently accessed control element.

DETAILED DESCRIPTION OF THE INVENTION

An embodiment of an electric equipment assembly and an outdoor unit of an air conditioner provided with the same according to the present invention is now described with reference to the drawings.

(1) Entire Structure of the Outdoor Unit

Figure 1:
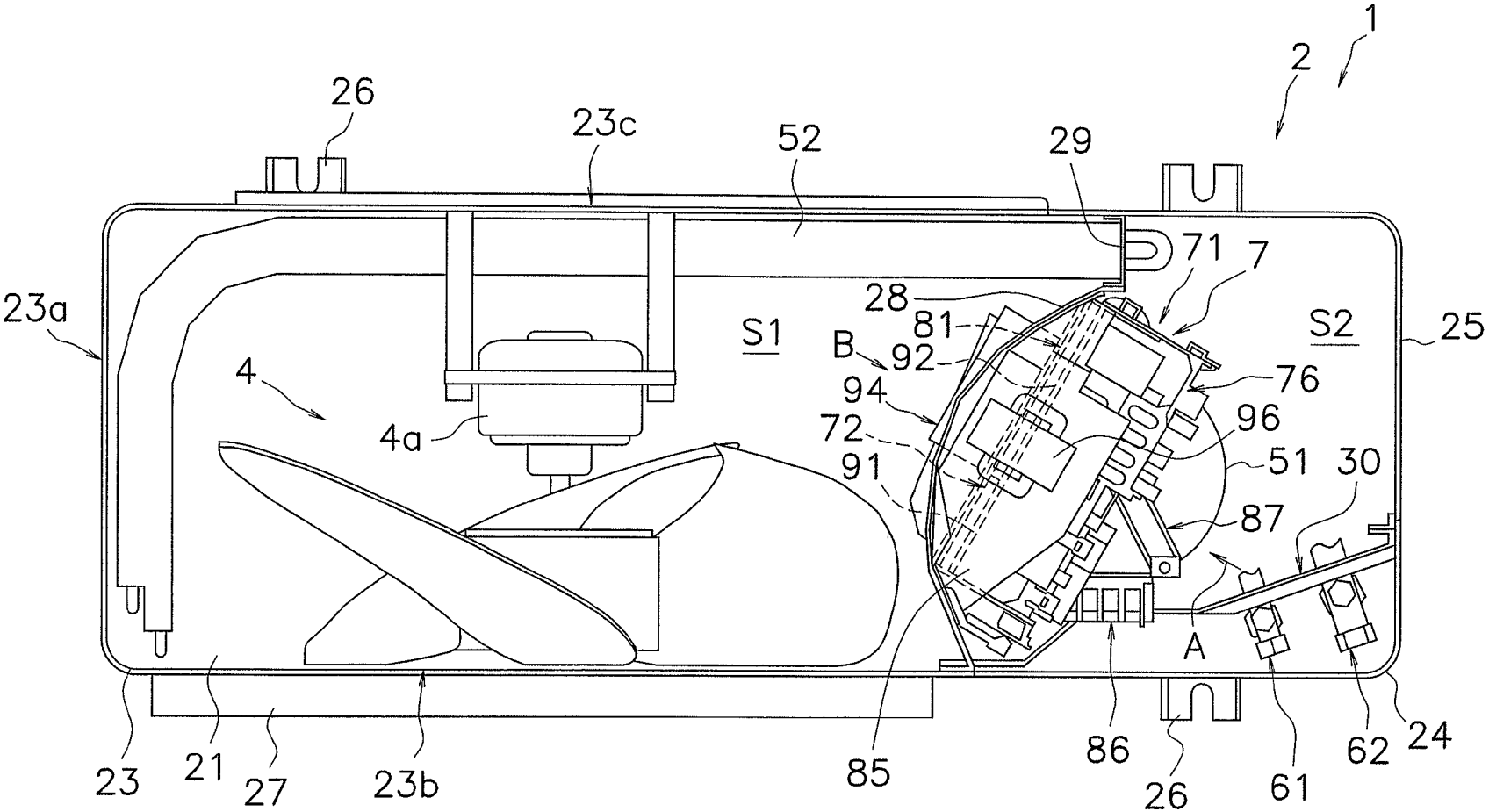
FIG. 1 is a plan view of an outdoor unit in which an embodiment of an electric equipment assembly according to the present invention is adopted (shown with a top plate and refrigerant circuit components other than a compressor, an outdoor heat exchanger, and shut-off valves removed).
Figure 2:
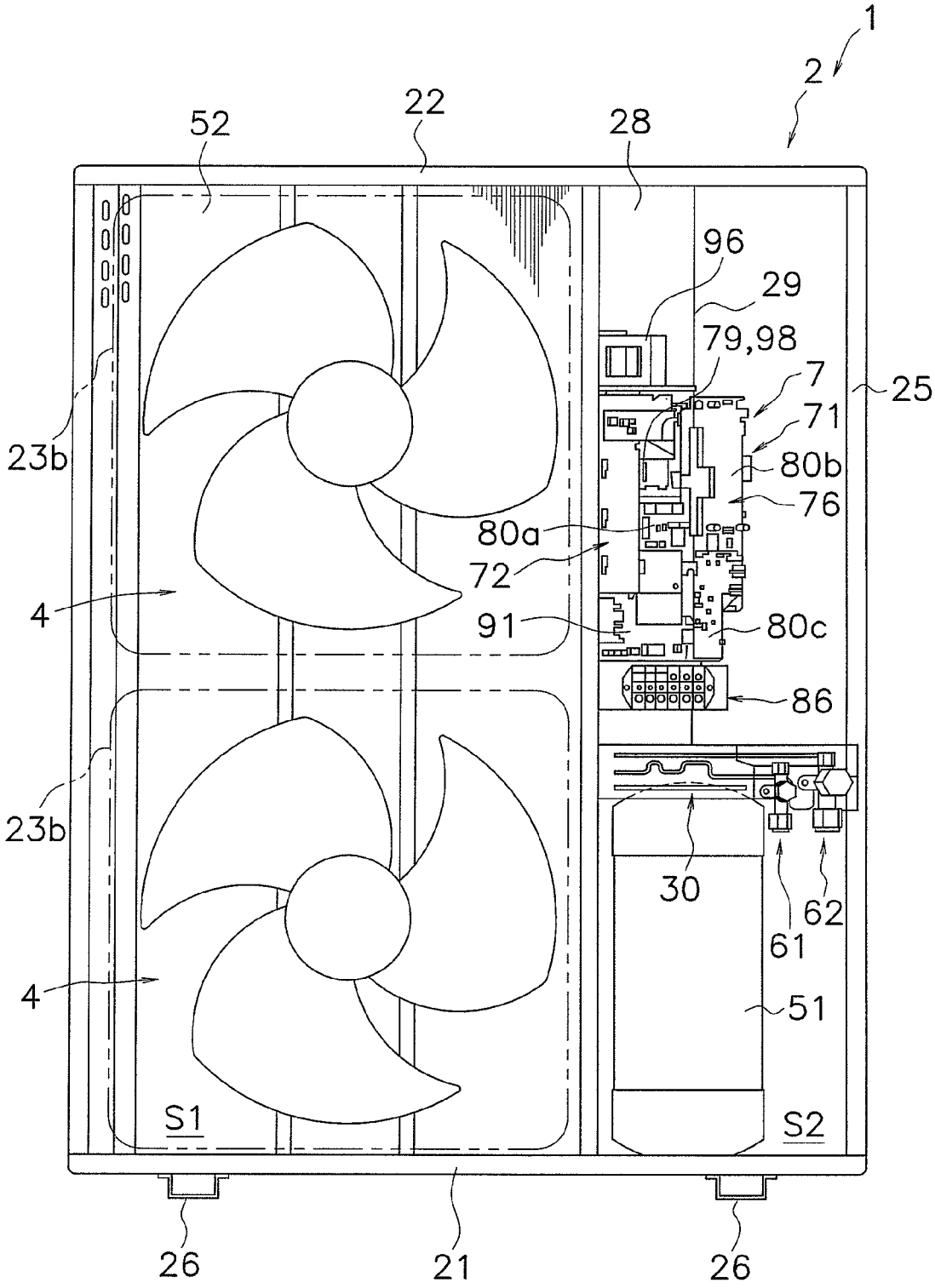
FIG. 2 is an elevation view of the outdoor unit (with left and right front plates and refrigerant circuit components other than the compressor, the outdoor heat exchanger, and the shut-off valves removed).

FIG. 1 is a plan view of an outdoor unit 1 in which an embodiment of the electric equipment assembly according to the present invention is adopted (shown with a top plate 22 and refrigerant circuit components 5 other than a compressor 51, an outdoor heat exchanger 52, and shut-off valves 61, 62 removed). In addition, FIG. 2 is an elevation view of the outdoor unit 1 (with left and right front plates 23, 24 and the refrigerant circuit components 5 other than the compressor 51, the outdoor heat exchanger 52, and the shut-off valves 61, 62 removed).

This outdoor unit 1 is installed outside, and has a so-called trunk structure in which the inside of a generally rectangular parallelepiped box shaped unit casing 2 is divided into a fan chamber S1 and a machine chamber S2 by a partition plate 28 extending vertically. This outdoor unit 1 is connected to an indoor unit (not shown) placed in an air-conditioned room via a refrigerant pipe (not shown). The outdoor unit 1 mainly comprises: the unit casing 2 having a generally rectangular parallelepiped box shape; outdoor fans 4; the refrigerant circuit components 5 including devices such as the compressor 51 and the outdoor heat exchanger 52, valves such as the liquid side shut-off valve 61 and the gas side shut-off valve 62, and members such as pipes so as to constitute a refrigerant circuit; and an electric equipment assembly 7 configured to control the operation of the outdoor unit 1. Note that in the description below, unless otherwise specified particularly, terms such as "up," "down," "left," "right," "front", "back," "front side," and "rear side" indicate the directions when the outdoor unit 1 shown in FIG. 2 is viewed from the front side thereof.

(2) Structure of the Unit Casing

The unit casing 2 mainly comprises a base plate 21, the top plate 22, the left front plate 23, the right front plate 24, and a right side plate 25.

The base plate 21 is a metallic plate-like member having a horizontally long and generally rectangular shape, which constitutes a base portion of the unit casing 2. The peripheral portion of the base plate 21 is bent upwardly. The outer surface of the base plate 21 is provided with two stationary legs 26 that are fixed on the installation surface at work site. Each of the stationary legs 26 has a generally U-shape in a front view of the unit casing 2, and is a metallic plate-like member which extends from the front side of the unit casing 2 to the rear side thereof.

The top plate 22 is a metallic plate-like member having a horizontally long and generally rectangular shape, which constitutes a top portion of the outdoor unit 1.

The left front plate 23 is a metallic plate-like member that mainly constitutes a left portion of the front side and a left side portion of the unit casing 2, and the lower portion of the left front plate 23 is fixed to the base plate 21 by a screw or the like. The left front plate 23 has an intake port 23*a* formed therein for air to be drawn into the unit casing 2 by the outdoor fans 4. In addition, the left front plate 23 is provided with discharge ports 23*b* for blowing out the air drawn inside from the rear side and the left side of the unit casing 2 by the outdoor fans 4. There are two discharge ports 23*b* formed above and below, each having a fan grille 27 provided thereto.

The right front plate 24 is a metallic plate-like member that mainly constitutes a right portion of the front side and a front portion of the right side of the unit casing 2, and the lower portion of the right front plate 24 is fixed to the base plate 21 by a screw or the like. In addition, the left end portion of the right front plate 24 is fixed to the right end portion of the left front plate 23 by a screw or the like.

The right side plate 25 is a metallic plate-like member that mainly constitutes a rear portion of the right side and a right rear side portion of the unit casing 2, and the lower portion of the right side plate 25 is fixed to the base plate 21 by a screw or the like. Between the back end portion of the left front plate 23 and the rear side end portion of the right side plate 25 in the horizontal direction, there is formed an intake port 23*c* for air to be drawn into the unit casing 2 by the outdoor fans 4.

Inside this type of unit casing 2 is provided with the partition plate 28 and a tube sheet 29. The partition plate 28 is a vertically extending metallic plate-like member disposed on the base plate 21, and the partition plate 28 is disposed so as to divide the inside of the unit casing 2 into two spaces, i.e., a left space and a right space. In this embodiment, the partition plate 28 has a bent shape so as to protrude toward the fan chamber S1 in a plan view of the unit casing 2. The tube sheet 29 is a metallic plate-like member provided so as to face the right end side of the outdoor heat exchanger 52 having a generally L-shape and disposed so as to extend along the unit casing 2 from the left side to the rear side thereof, and the lower portion of the tube sheet 29 is fixed to the base plate 21 by a screw or the like. The end portion of the tube sheet 29 on the front side of the unit casing 2 and the end portion of the partition plate 28 on the rear side of the unit casing 2 are fixed to each other by a screw or the like. In addition, the right end portion of the left front plate 23 is fixed to the partition plate 28 at the front end portion thereof by a screw or the like. The end portion on the rear side of the right side plate 25 is fixed to the tube sheet 29 at the end portion thereof on the rear side of the unit casing 2 by a screw or the like.

In this way, the inside of the unit casing 2 is divided into the fan chamber S1 and a machine chamber S2 by the partition plate 28. More specifically, the fan chamber S1 is a space surrounded by the base plate 21, the top plate 22, the left front plate 23, and the partition plate 28, and mainly the outdoor fans 4 and the outdoor heat exchanger 52 are disposed therein. The machine chamber S2 is a space surrounded by the base plate 21, the top plate 22, the right front plate 24, the right side plate 25, and the partition plate 28, and mainly the electric equipment assembly 7 and the refrigerant circuit components 5 other than the outdoor heat exchanger 52 are disposed therein. The unit casing 2 is configured such that the inside of the machine chamber S2 will be exposed by removing the right front plate 24. In other words, the right front plate 24 is removed when working on site to perform maintenance and the like of the refrigerant circuit components 5 and the electric equipment assembly 7 housed in the machine chamber S2 of the outdoor unit 1.

(3) Structure of the Outdoor Fan

Each of the outdoor fans 4 is a propeller fan having a plurality of blades and is disposed on the front side of the outdoor heat exchanger 52 in the fan chamber S1. In this embodiment, two outdoor fans 4 are disposed above and below in the fan chamber S1 so as to face the discharge ports 23*b*. Each of these outdoor fans 4 is configured to be rotatably driven by an outdoor fan electric motor 4*a*. When the outdoor fans 4 are driven, air is drawn into the inside of the unit casing 2 through the intake ports 23*a*, 23*c* on the rear side and the left side of the unit casing 2. After the air passes through the outdoor heat exchanger 52, the air is blown out to the outside of the unit casing 2 from the discharge ports 23*b* on the front side of the unit casing 2.

(4) Structure of the Refrigerant Circuit Component

The compressor 51 is a hermetic compressor that houses a compressor electric motor in the housing, and is disposed in the machine chamber S2. Here, the compressor electric motor is a so-called inverter driven electric motor in which the frequency can be controlled by the electric equipment assembly 7. In this embodiment, the compressor 51 has a longitudinal cylinder shape whose height is about ⅓ to ½ of the overall height of the unit casing 2, and a lower portion of the compressor 51 is fixed to the base plate 21. In addition, in a plan view of the unit casing 2, the compressor 51 is disposed near in the center of the machine chamber S2 in the front and back direction and also near the partition plate 28 of the machine chamber S2.

The outdoor heat exchanger 52 is disposed in the fan chamber S1. Through the outdoor heat exchanger 52, heat exchange is performed with the air that is drawn into the unit casing 2 by the outdoor fans 4. The outdoor heat exchanger 52 has a generally L-shape in a plan view of the unit casing 2, and is disposed so as to extend along the unit casing 2 from the left side to the rear side thereof.

Inside the unit casing 2, the liquid side shut-off valve 61 and the gas side shut-off valve 62 are disposed, to which refrigerant pipes on the indoor unit side are connected. More specifically, the liquid side shut-off valve 61 and the gas side shut-off valve 62 are disposed at a position facing the right front plate 24 at the front portion of the machine chamber S2. In this embodiment, the liquid side shut-off valve 61 and the gas side shut-off valve 62 are supported by an elongated plate shaped shut-off support member 30 provided so as to extend between the right end portion of the left front plate 23 and the front end portion of the right side plate 25. The shut-off support member 30 is disposed at a height near the upper end of the compressor 51 in the machine chamber S2.

(5) Structure of the Electric Equipment Assembly

The electric equipment assembly 7 includes various electric components such as a control circuit board 91 mounted with the operating control element for controlling operation and the inverter control element 92. In this embodiment, the electric equipment assembly 7 is disposed near the partition plate 28 at the upper portion in the machine chamber S2. The electric equipment assembly 7 mainly includes a frame 71, a terminal block 86, and a terminal block support member 87.

Figure 3:
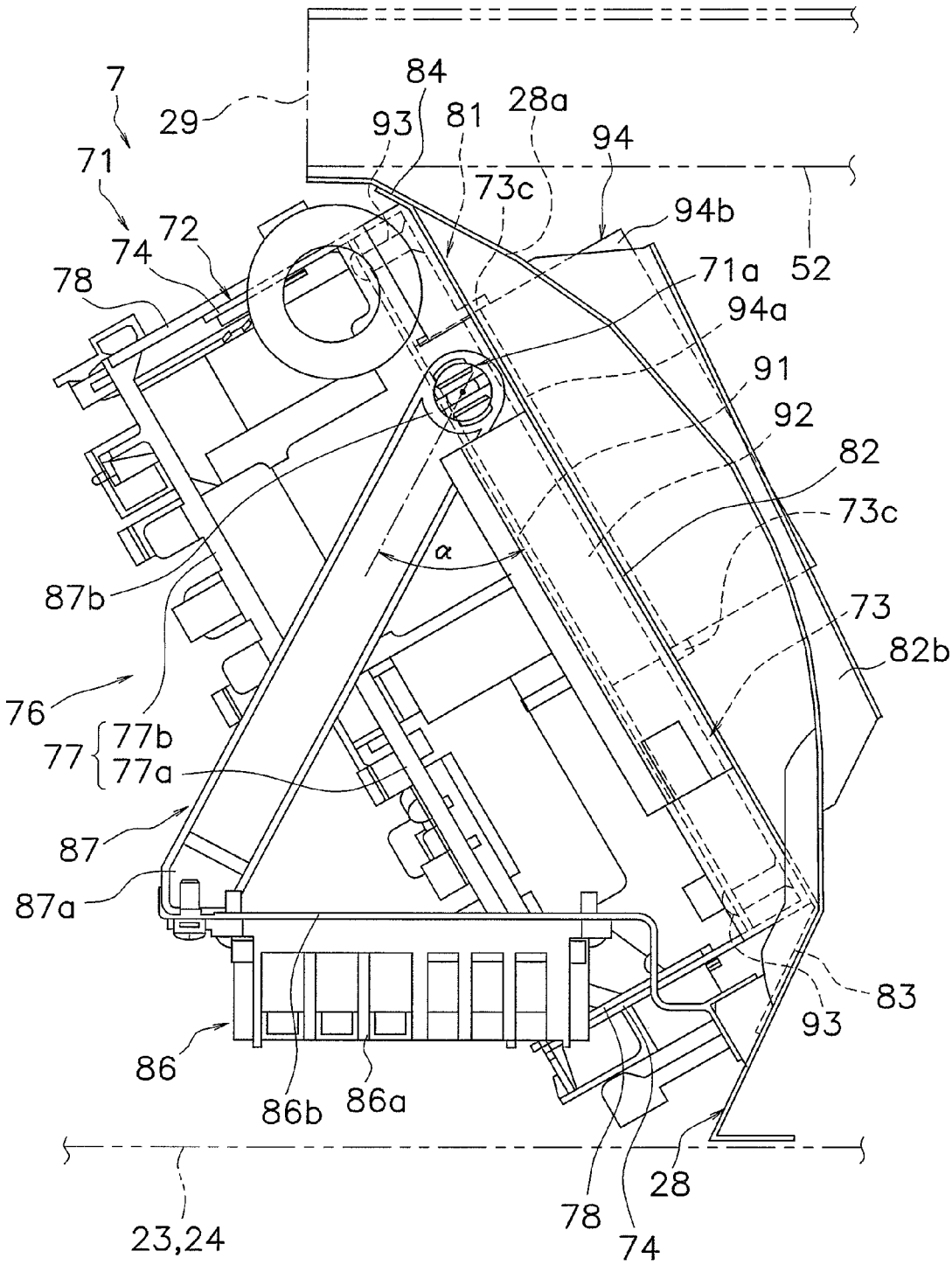
FIG. 3 is a view of the electric equipment assembly provided in a machine chamber viewed from the bottom.
Figure 4:
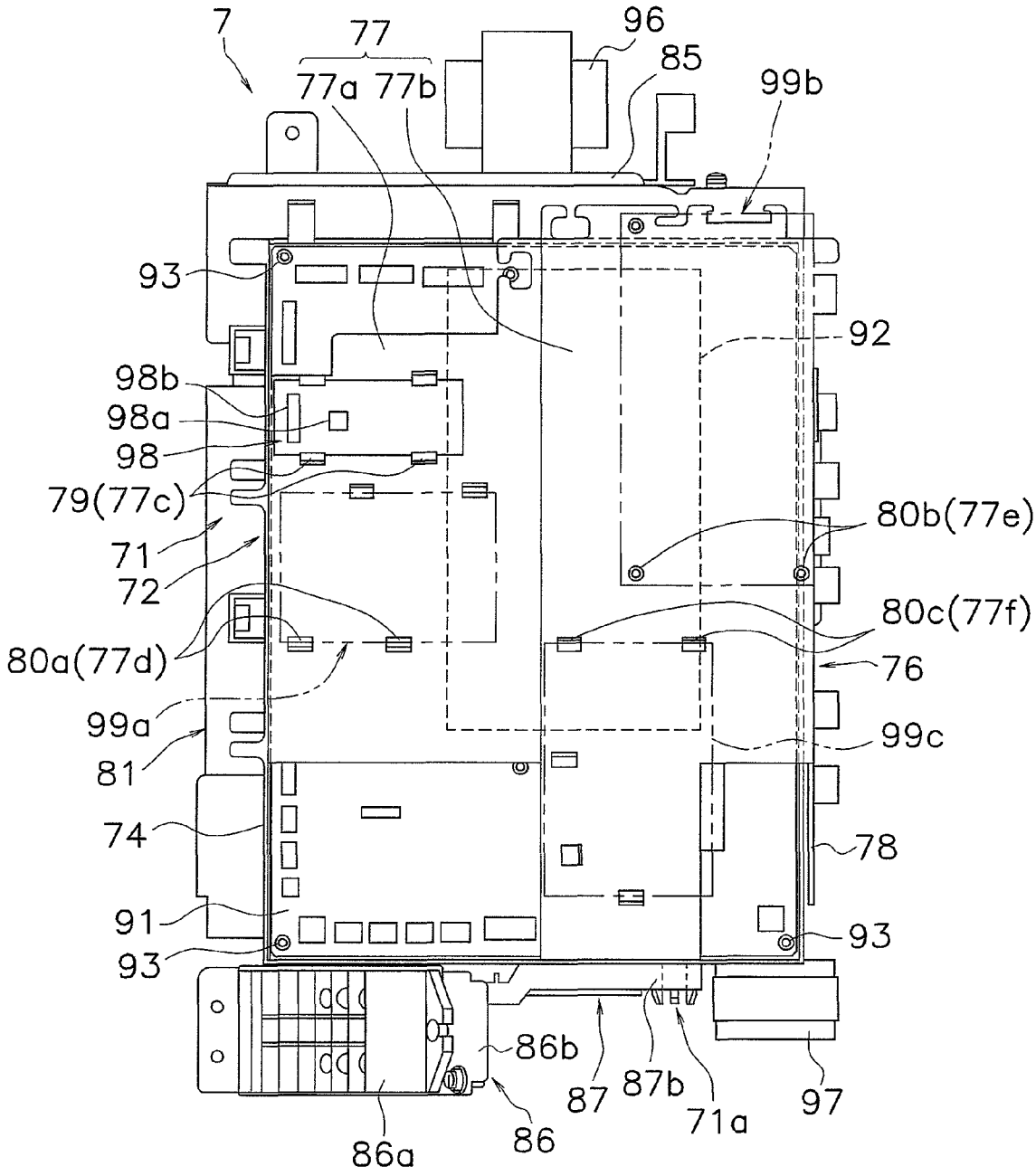
FIG. 4 is a view of the electric equipment assembly provided in the machine chamber, viewed in a direction A in FIG. 1.
Figure 5:
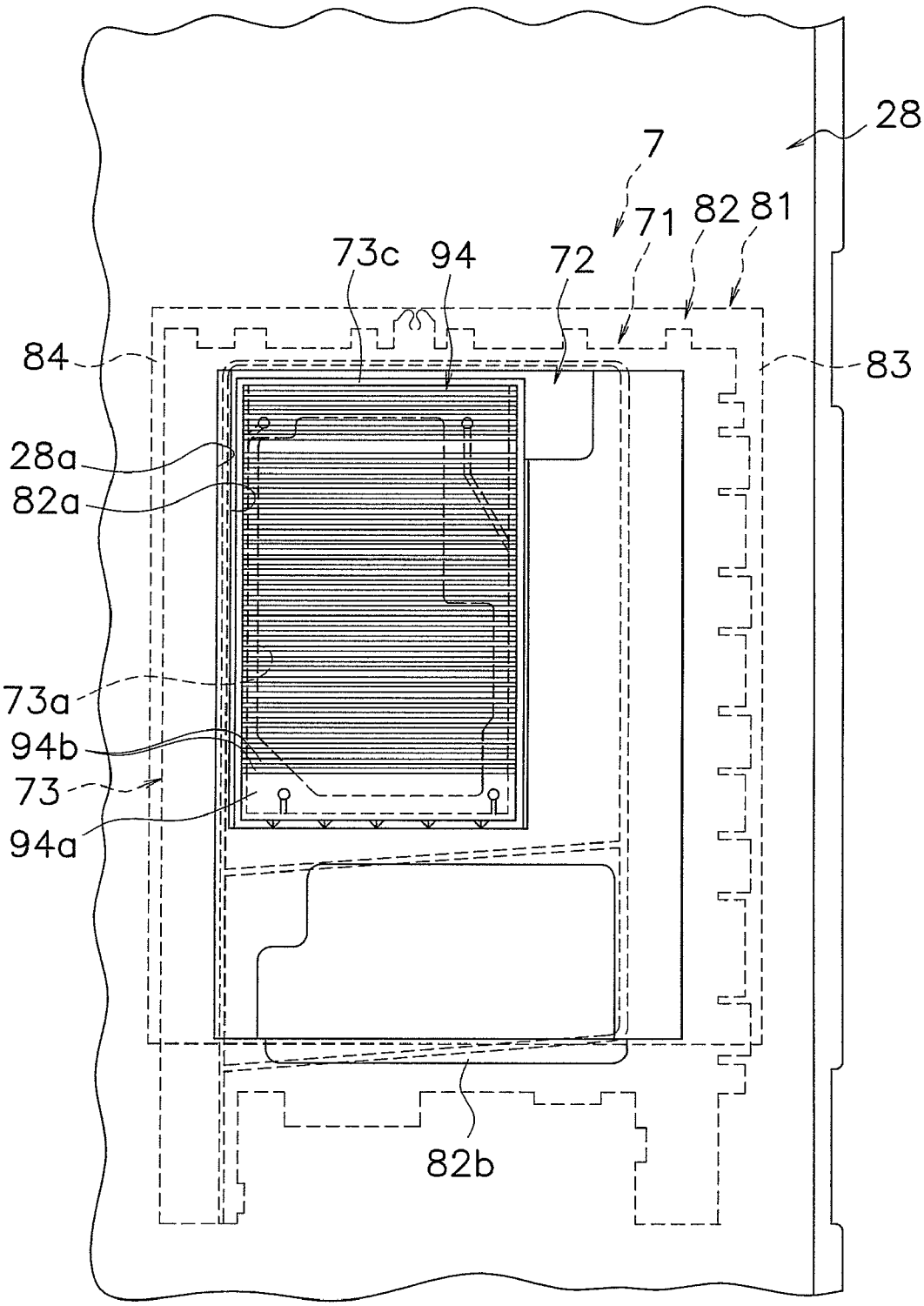
FIG. 5 is a view of the electric equipment assembly provided in the machine chamber, viewed in a direction B in FIG. 1.
Figure 6:
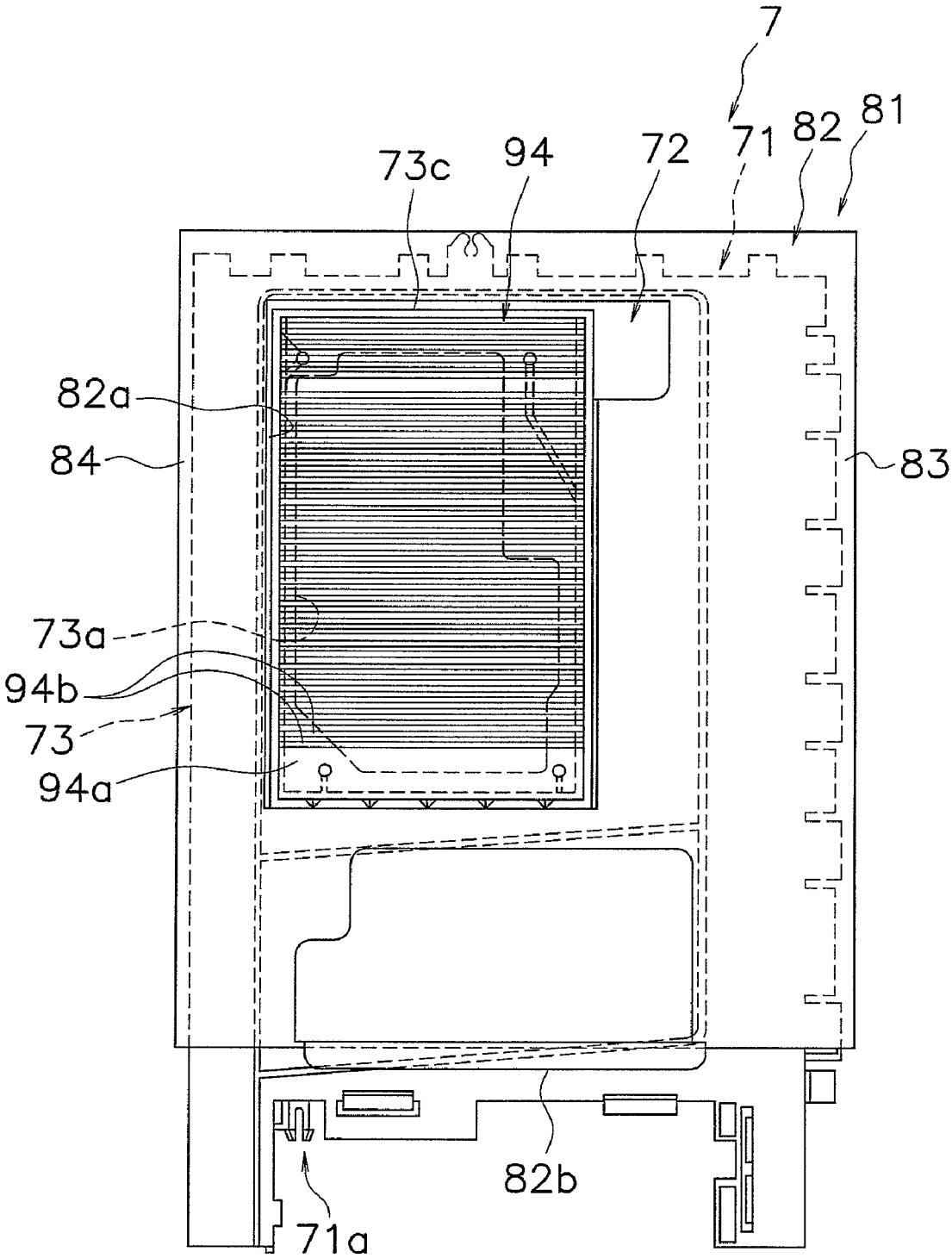
FIG. 6 is a view of a state in which a partition plate is removed from FIG. 5.

Next, the structure of the electric equipment assembly 7 is described in detail with reference to FIGS. 3 to 6. Here, FIG. 3 is a view of the electric equipment assembly 7 provided in the machine chamber S2, viewed from the bottom. FIG. 4 is a view of the electric equipment assembly 7 provided in the machine chamber S2, viewed in the direction A in FIG. 1. FIG. 5 is a view of the electric equipment assembly 7 provided in the machine chamber S2, viewed in the direction B in FIG. 1. FIG. 6 is a view of the electric equipment assembly 7, with the partition plate 28 removed from FIG. 5.

The frame 71 is a generally rectangular parallelepiped box shaped member made of resin, to which various electric components including the control circuit board 91 mounted with the operating control element and the inverter control element 92 are attached. The frame 71 mainly comprises a substrate attachment plate 72 to which various electric components including the control circuit board 91 and the inverter control element 92 are attached, and a substrate protection plate 76 that covers the control circuit board 91.

The substrate attachment plate 72 is a member disposed on the fan chamber S1 side in the machine chamber S2, with the electric equipment assembly 7 disposed in the machine chamber S2. The substrate attachment plate 72 mainly includes an attachment plate portion 73 as a first plate which is inclined to the front side of the unit casing 2 (i.e., the front side portions of the left and right front plates 23, 24) and which extends vertically, and an attachment frame portion 74 which extends from the outer perimeter of the attachment plate portion 73 toward a side opposite the fan chamber S1. An attachment plate opening 73*a* is formed generally in the center of the attachment plate portion 73 when the attachment plate portion 73 is seen in the direction of arrow A or arrow B. The surface of the attachment plate portion 73 on the side opposite the fan chamber S1 has an inverter control element 92 attached thereto, at a position facing the attachment plate opening 73*a*. The inverter control element 92 is, for example, an electric component such as a power transistor, a diode, etc., which generates high temperature heat during operation. In addition, the control circuit board 91 mounted with an operating control element is attached to the surface of the attachment plate portion 73 on the side opposite the fan chamber S1, with the control circuit board 91 in parallel to the surface of the attachment plate portion 73, by using a plurality of screws 93. In other words, as is the case with the attachment plate portion 73, the substrate surface of the control circuit board 91 is inclined to the front side of the unit casing 2 and extends vertically. In this embodiment, the control circuit board 91 is disposed so as to sandwich the inverter control element 92 between the control circuit board 91 and the surface of the attachment plate portion 73 on the side opposite the fan chamber S1, and the control circuit board 91 is integrated with the inverter control element 92. In addition, a heat sink 94 is attached to the surface of the attachment plate portion 73 on the fan chamber S1 side so as to cover the attachment plate opening 73*a*. The heat sink 94 mainly includes a flange portion 94*a* attached to the surface of the attachment plate portion 73 on the fan chamber S1 side, and a plurality of horizontal cooling fins 94*b* that protrude from the surface of the flange portion 94*a* on the fan chamber S1 side toward the inside of the fan chamber S1. The flange portion 94*a* is a generally rectangular shaped plate portion. An annular projecting portion 73*c* that protrudes toward the fan chamber S1 is formed on the surface of the attachment plate portion 73 on the fan chamber S1 side so as to surround the outer perimeter of the flange portion 94*a*.

The substrate protection plate 76 is a member disposed to the substrate attachment plate 72 on the side opposite the fan chamber S1, with the electric equipment assembly 7 provided in the machine chamber S2. The substrate protection plate 76 mainly includes a protection plate portion 77 which is inclined to the front side of the unit casing 2 (i.e., the front side portions of the left and right front plates 23, 24) and which extends vertically, and a protection frame portion 78 which extends from the outer perimeter of the protection plate portion 77 toward the fan chamber S1 side. With the electric equipment assembly 7 provided in the machine chamber S2, the protection plate portion 77 mainly includes a front side protection plate portion 77*a* disposed closer to the front side of the unit casing 2, and a rear side protection plate portion 77*b* disposed further from the front side of the unit casing 2 compared to the front side protection plate portion 77*a*. The rear side protection plate portion 77*b* is integrated with the front side protection plate portion 77*a*, with the rear side protection plate portion 77*b* protruding in the direction of arrow B compared with the front side protection plate portion 77*a*, via a step formed generally in the center of the protection plate portion 77 in the horizontal direction, when the protection plate portion 77 is seen in the direction of arrow A. The front side protection plate portion 77*a* and the rear side protection plate portion 77*b* are disposed in parallel to the surface of the attachment plate portion 73. The protection frame portion 78 is disposed such that the end portion thereof and the end portion of the attachment frame portion 74 in the direction of arrow A or arrow B overlap with each other, when the protection frame portion 78 is seen in the direction perpendicular to the attachment frame portion 74 in the direction of arrow A or arrow B. The substrate protection plate 76 is attached to the substrate attachment plate 72 by using an engaging claw formed on the protection frame portion 78 or the attachment frame portion 74, screw, or the like. In addition, apart from the control circuit board 91, a first auxiliary circuit board 98 is attached to the outer surface of the front side protection plate portion 77*a* (i.e. the surface seen when the substrate protection plate 76 is viewed in the direction of arrow A). The first auxiliary circuit board 98 is mounted with a highly frequently accessed control element among various operating control elements, which requires visibility and serviceability (for example, a display element 98*a* such as an LED and the like, and an operating element 98*b* such as a switch, connector, and the like). Here, the first auxiliary circuit board 98 is fixed on a first auxiliary circuit board attachment portion 79 including a plurality of (four in this case) locking claws 77*c* formed on the outer surface of the front side protection plate portion 77*a*. Further, with the electric equipment assembly 7 disposed in the machine chamber S2, it is possible to attach second auxiliary circuit boards 99*a*, 99*b*, and 99*c* respectively to the lower side of the first auxiliary circuit board attachment portion 79 of the front side protection plate portion 77*a*, an upper portion of the rear side protection plate portion 77*b*, and a lower portion of the rear side protection plate portion 77*b*. Each of the second auxiliary circuit boards 99*a*, 99*b*, and 99*c* is mounted with an additional-function control element, which is an element necessary for adding an additional function (for example, communication function, demand control function, etc.). Here, the second auxiliary circuit board 99*a* can be fixed on a second auxiliary circuit board attachment portion 80*a* including a plurality of (four in this case) locking claws 77*d* formed on the outer surface of the front side protection plate portion 77*a*. The second auxiliary circuit board 99*b* can be fixed on a second auxiliary circuit board attachment portion 80*b* including a plurality of (three in this case) screw holes 77*e* formed on the outer surface of the rear side protection plate portion 77*b*. The second auxiliary circuit board 99*c* can be fixed on a second auxiliary circuit board attachment portion 80*c* including a plurality of (three in this case) locking claws 77*f* formed on the outer surface of the rear side protection plate portion 77*b*. Note that even when the frame 71 (i.e., the substrate protection plate 76) is viewed in the direction of arrow A, the frame 71 is inclined to the front side of the unit casing 2 such that the entirety of the highly frequently accessed control elements 98*a*, 98*b* (i.e., the whole first auxiliary circuit board 98) are visible, without being hidden by the lateral sides of the unit casing 2 (i.e., the lateral side portion of the right front plate 24 and the lateral side portion of the right side plate 25). More specifically, when the frame 71 (i.e., the substrate protection plate 76) is viewed in the direction of arrow A, the frame 71 is inclined to the front side of the unit casing 2 such that the front end of the lateral side of the unit casing 2 substantially overlaps with the step extending in an up and down direction of the substrate protection plate 76.

In addition, with the electric equipment assembly 7 provided in the machine chamber S2, a reactor 96 is attached to the upper surface of the frame 71 via a metallic reactor attachment plate 85, and a noise filter 97 is attached to the lower surface of the frame 71.

The frame 71 to which the above described various electric components and the heat sink 94 are attached has a frame support plate 81 that is fixed thereto so as to cover the surface of the attachment plate portion 73 on the fan chamber S1 side. The frame support plate 81 is a metallic member. With the electric equipment assembly 7 provided in the machine chamber S2, the frame support plate 81 mainly includes a support plate portion 82 as a second plate portion in contact with the surface of the attachment plate portion 73 on the fan chamber S1 side, and a front side extension portion 83 and a rear side extension portion 84 which extend along the bent surface of the partition plate 28 from both side edges of the support plate portion 82. Here, the support plate portion 82 covers substantially the entire surface of the attachment plate portion 73 except for the lower portion thereof. The support plate portion 82 has a support plate opening 82*a* formed therein as a second opening so as to surround the outer peripheral side of the annular projecting portion 73*c* formed on the attachment plate portion 73. Accordingly, with the frame 71 fixed to the frame support plate 81, the plurality of cooling fins 94*b* of the heat sink 94 attached to the frame 71 penetrate through the support plate opening 82*a* and protrude toward the fan chamber S1 side of the support plate portion 82. In addition, the support plate portion 82 has a tongue portion 82*b* formed thereon by bending and the like, whose lower end extends toward the fan chamber S1 side and then extends downwardly. With the frame 71 fixed to the partition plate 28, the frame support plate 81 is fixed to the partition plate 28 by using, for example, an engaging claw formed on the front side extension portion 83, the rear side extension portion 84, or the support plate portion 82, a screw, or the like. Here, the partition plate 28 has a generally rectangular shaped partition plate opening 28*a* formed therein as a first opening so as to communicate the fan chamber S1 and the machine chamber S2. The partition plate opening 28*a* is formed so as to face the support plate opening 82*a* and to surround the support plate opening 82*a* and the lower end of the support plate portion 82 when the partition plate opening 28*a* is viewed in the direction of arrow B. Accordingly, with the frame 71 fixed to the partition plate 28 via the frame support plate 81, the plurality of cooling fins 94*b* of the heat sink 94 and the tongue portion 82*b* of the frame support plate 81 protrude into the fan chamber S1 and are capable of cooling the inverter control element 92 during operation. In addition, with the frame 71 disposed in the machine chamber S2, the frame 71 is provided such that the substrate surface of the control circuit board 91 extends along the partition plate 28 and such that the substrate surface of the control circuit board 91 is inclined to the front side of the unit casing 2. Further, a corner of the frame 71 is in contact with the partition plate 28 along a bent surface thereof via a frame support plate 81, when the electric equipment assembly 7 disposed in the machine chamber S2 is viewed from the top.

The terminal block 86 mainly includes a terminal block body 86*a* having a plurality of terminals for power supply connection, and a terminal block fixing plate 86*b* to which the rear side of the terminal block body 86*a* is fixed. With the electric equipment assembly 7 provided in the machine chamber S2, the terminal block 86 is disposed such that a terminal portion of the terminal block body 86*a* faces the front side of the unit casing 2, and one end of the terminal block fixing plate 86*b* on the partition plate 28 side is fixed to the partition plate 28. Note that one end of the terminal block fixing plate 86*b* may be fixed to the front portion of the left front plate 23.

The terminal block support member 87 is a rod shaped member having a first terminal block support portion 87*a* configured to support the terminal block 86 with the electric equipment assembly 7 provided in the machine chamber S2, and a frame supported portion 87*b* rotatably supported around an engaging shaft 71*a* (whose shaft center is O), which is a shaft that extends in an up and down direction of the frame 71 with the electric equipment assembly 7 provided in the machine chamber S2. The terminal block support member 87 is capable of moving the first terminal block support portion 87*a* closer to or away from the substrate surface of the control circuit board 91, by rotating the frame supported portion 87*b*. The other end of the terminal block fixing plate 86*b* is supported by being attached to the first terminal block support portion 87*a* by setting the terminal block support member 87 to the first state in which the terminal block support member 87 is inclined by an angle α.

In this way, with the electric equipment assembly 7 of this embodiment, the terminal block 86, apart from the frame 71, is fixed to the partition plate 28 so as to face the front side of the unit casing 2, and the terminal block 86 is also supported by the terminal block support member 87 provided to the frame 71.

(6) Characteristics of the Electric Equipment Assembly of the Present Embodiment and the Outdoor Unit Provided with the Same The electric equipment assembly 7 of the present embodiment and the outdoor unit 1 provided with the same have the following characteristics.

(A)

With the electric equipment assembly 7 and the outdoor unit 1 provided with the same as described in the present embodiment, the outer surface of the substrate protection plate 76 (more specifically the protection plate portion 77) has the first auxiliary circuit board attachment portion 79 formed thereon, to which the first auxiliary circuit board 98 different from the control circuit board 91 and mounted with the highly frequently accessed control elements 98*a*, 98*b* is attached. Accordingly, it is not necessary to mount the highly frequently accessed control elements on the control circuit board 91, thus facilitating reduction in size and simultaneously enabling access to the highly frequently accessed control elements 98*a*, 98*b* from the outer surface of the substrate protection plate 76. This structure enables simultaneously achieving reduction in size of the electric equipment assembly 7 and ensuring visibility and serviceability of the highly frequently accessed control elements 98*a*, 98*b*. In addition, with the outdoor unit 1 provided with this type of electric equipment assembly 7, it is possible to achieve reduction in size of the outdoor unit 1 itself.

(B)

With the electric equipment assembly 7 of the present embodiment, it is possible to attach the second auxiliary circuit boards 99*a*, 99*b*, 99*c* mounted with additional-function control elements necessary for adding additional functions to the outer surface of substrate protection plate 76, thus facilitating reduction in size of the electric equipment assembly 7 and adding an additional function at the same time.

(C)

With the electric equipment assembly 7 of the present embodiment, the highly frequently accessed control elements 98*a*, 98*b* are disposed closer to the front side of the casing 2 (in other words, the front side protection plate portion 77*a*), thus further improving visibility and serviceability of the highly frequently accessed control elements 98*a*, 98*b*.

(D)

With the electric equipment assembly 7 of the present embodiment, the rear side protection plate portion 77*b* protrudes in the direction of arrow B compared with the front side protection plate portion 77*a*. Therefore, although the second auxiliary circuit board attachment portions 80*b*, 80*c* are disposed at the rear side protection plate portion 77*b* (in other words, at the position closer to the bask side of the unit casing 2), it is possible to easily ensure visibility and serviceability of the additional-function control elements mounted on the second auxiliary circuit boards 99*b*, 99*c* when the second auxiliary circuit boards 99*b*, 99*c* are attached to the second auxiliary circuit board attachment portions 80*b*, 80*c*.

(E)

With the electric equipment assembly 7 of the present embodiment, the frame 71 is provided such that the outer surface of the substrate protection plate 76 is inclined to the front side of the unit casing 2, thus further improving visibility and serviceability of the highly frequently accessed control elements 98*a*, 98*b*.

Further, the electric equipment assembly 7 of the present embodiment is inclined to the front side of the unit casing 2 such that the entirety of the highly frequently accessed control elements 98*a*, 98*b* is visible, without being hidden by the lateral sides of the unit casing 2 even when the electric equipment assembly 7 is viewed in a direction perpendicular to the substrate surface of the control circuit board 91. Accordingly, even when a plurality of outdoor units 1 each provided with this type of electric equipment assembly 7 are installed, visibility and serviceability of the highly frequently accessed control elements 98*a*, 98*b* can be maintained in good condition, and on-site workability can be further improved.

In addition, even when the electric equipment assembly 7 has the second auxiliary circuit boards 99*a*, 99*b*, 99*c* attached thereto, on which the additional-function control elements for adding additional functions are mounted, it is possible to further improve visibility and serviceability of the additional-function control elements.

INDUSTRIAL APPLICABILITY

With the utilization of the present invention, in an electric equipment assembly disposed in a machine chamber of an outdoor unit of an air conditioner having a structure in which an inside of a casing having a generally rectangular parallelepiped box shape is divided into a fan chamber and the machine chamber by a partition plate extending vertically, it is possible to simultaneously reduce the size of the electric equipment assembly and ensure visibility and serviceability of a highly frequently accessed control element, while employing a structure in which a control circuit board is covered by a protection cover.

What is claimed is:

1. An electric equipment assembly sized and configured to be disposed in a machine chamber of an outdoor unit of an air conditioner having a structure in which an inside of casing having a generally rectangular parallelepiped box shape is divided into a fan chamber and the machine chamber by a partition plate extending vertically, the electric equipment assembly comprising:

a frame having a substrate attachment plate and a substrate protection plate;

a control circuit board attached to the substrate attachment plate, the control circuit board being mounted with a plurality of electric components, the substrate protection plate being arranged and configured to cover the control circuit board; and a first auxiliary circuit board attached to a first auxiliary attachment portion formed on an outer surface of the substrate protection plate, the first auxiliary circuit board being different from the control circuit board and mounted with a frequently accessed control element.

2. The electric equipment assembly according to claim 1, further comprising a second auxiliary circuit board attached to a second auxiliary attachment portion formed on the outer surface of the substrate protection plate, the second auxiliary circuit board being mounted with an additional-function control element necessary for adding an additional function.

3. The electric equipment assembly according to claim 1, wherein the first auxiliary attachment portion is provided on the outer surface of the substrate protection plate at a position closer to a front side of the casing when the frame is disposed in the machine chamber of the casing.

4. The electric equipment assembly according to claim 1, wherein the frame is provided such that the outer surface of the substrate protection plate is inclined relative to a front side of the casing when the frame is disposed in the machine chamber of the casing.

5. An outdoor unit of an air conditioner comprising:

a casing having a generally rectangular parallelepiped box shape;

a partition plate extending vertically so as to divide the inside of the casing into a fan chamber and a machine chamber; and an electric equipment assembly disposed in the machine chamber, the electric equipment assembly including a frame having a substrate attachment plate and a substrate protection plate, a control circuit board attached to the substrate attachment plate, the control circuit board being mounted with a plurality of electric components, the substrate protection plate being arranged and configured to cover the control circuit board, and a first auxiliary circuit board attached to a first auxiliary attachment portion formed on an outer surface of the substrate protection plate, the first auxiliary circuit board being different from the control circuit board and mounted with a frequently accessed control element.

6. The outdoor unit according to claim 5, wherein the electric equipment assembly includes a second auxiliary circuit board attached to a second auxiliary attachment portion formed on the outer surface of the substrate protection plate, the second auxiliary circuit board being mounted with an additional-function control element necessary for adding an additional function.

7. The outdoor unit according to claim 6, wherein the first auxiliary attachment portion is provided on the outer surface of the substrate protection plate at a position closer to a front side of the casing.

8. The outdoor unit according to claim 7, wherein the frame is arranged in the machine chamber such that the outer surface of the substrate protection plate is inclined relative to the front side of the casing.

9. The outdoor unit according to claim 5, wherein the first auxiliary attachment portion is provided on the outer surface of the substrate protection plate at a position closer to a front side of the casing.

10. The outdoor unit according to claim 5, wherein the frame is arranged in the machine chamber such that the outer surface of the substrate protection plate is inclined relative to the front side of the casing.

11. The electric equipment assembly according to claim 2, wherein the first auxiliary attachment portion is provided on the outer surface of the substrate protection plate at a position closer to a front side of the casing when the frame is disposed in the machine chamber of the casing.

12. The electric equipment assembly according to claim 11, wherein the frame is provided such that the outer surface of the substrate protection plate is inclined relative to the front side of the casing when the frame is disposed in the machine chamber of the casing.

* * * * *

UNITED STATES PATENT AND TRADEMARK OFFICE

CERTIFICATE OF CORRECTION

PATENT NO. : 7,876,574 B2
APPLICATION NO. : 12/091006
DATED : January 25, 2011
INVENTOR(S) : Takeichi et al.

It is certified that error appears in the above-identified patent and that said Letters Patent is hereby corrected as shown below:

On the Title page change the listing of Item [87] from

"[87] PCT Pub. No.: WO2007/052786

PCT Pub. Date: Oct. 5, 2007"

to

-- [87] PCT Pub. No.: WO2007/052786

PCT Pub. Date: May 10, 2007 --

Signed and Sealed this
Thirty-first Day of May, 2011

David J. Kappos

David J. Kappos
*Director of the United States Patent and Trademark Office*